US005511353A

United States Patent [19]

Jones

[11] Patent Number: 5,511,353

[45] Date of Patent: Apr. 30, 1996

[54] DECKING SYSTEM AND CLIPS THEREFOR

[76] Inventor: Stephen L. Jones, P.O. Box 124, 8 Merriam Rd., Princeton, Mass. 01541

[21] Appl. No.: 345,165

[22] Filed: Nov. 28, 1994

Related U.S. Application Data

[63] Continuation of Ser. No. 159,716, Nov. 30, 1993, abandoned.

[51] Int. Cl.[6] ..... E04D 1/00

[52] U.S. Cl. ..... 52/536; 52/236.1; 52/357; 52/387; 52/584.1; 52/582.1; 52/460; 52/489.1

[58] Field of Search ..... 52/538, 536, 236.1, 52/357, 387, 736, 584.1, 581, 358, 359, 764, 582.1, 460, 715, 489.1, 712

[56] References Cited

U.S. PATENT DOCUMENTS

| | | | |
|---|---|---|---|
| 1,217,603 | 2/1917 | Jester | 52/357 |
| 2,909,251 | 10/1959 | Nelsson | 52/359 |
| 3,357,148 | 12/1967 | Turner | 52/489.1 |
| 4,170,859 | 10/1979 | Counihan | 52/763 |
| 4,600,337 | 7/1986 | Sarver | 52/538 |
| 4,622,792 | 11/1986 | Betts | 52/263 |
| 4,628,645 | 12/1986 | Tafelski, Jr. | 52/169.1 |

OTHER PUBLICATIONS

*Hawley's Condensed Chemical Dictionary,* 11th Edition, p. 933, Col. 1, Copyright 1987.

*Primary Examiner*—Carl D. Friedman
*Assistant Examiner*—W. Glenn Edwards
*Attorney, Agent, or Firm*—Bookstein & Kudirka

[57] ABSTRACT

A portable decking system formed from a plurality of flat panels adapted to be placed directly on the ground is provided with special clips that facilitate interconnection of adjacent edges of adjacent panels. The clips are generally W-shaped in cross-section to define a pair of channels each of which is receptive to a frame member of a flat panel. The clips are constructed to securely connect the panels together but in a manner that enables their ready detachment, all of which may be accomplished without tools or additional fasteners.

21 Claims, 3 Drawing Sheets

DECKING SYSTEM AND CLIPS THEREFOR

This is a continuation of the parent application Ser. No. 08/159,716 filed Nov. 30, 1993, which went abandoned Dec. 21, 1994.

FIELD OF THE INVENTION

This invention relates to decking systems formed from a plurality of interlocking panels adapted to be placed directly on the ground and to connector-spacer devices for connecting adjacent edges of such panels.

BACKGROUND OF THE INVENTION

Among the various types of decking systems is that of a plurality of flat panels that may be placed directly on the ground in a desired pattern to form a continuous deck surface. Such panels may be used in a wide variety of configurations including, for example, garden walkways, decks, pool side aprons, screen house floor systems, kennel floors and the like. The panels typically include a rectangular wooden frame with a plurality of flat boards attached to the frame to define the decking surface. The panel is placed frame surface down with the frame resting directly on the ground. Because the panels may be made in sizes small enough to be handled manually, such systems may be considered as portable, that is, they can be taken up and rearranged, stored or transported to another site. The portability of such decking systems enhances their use as seasonal decking so that they can be removed during the off season so as to reduce exposure to the elements.

Among the difficulties presented with such decking systems is that the panels tend to shift about thus resulting in discontinuities along the decking surface. Such shifting may result from one or more of weather, soil erosion or simply the forces applied to the system when it is walked upon. The surface discontinuities detract from the appearance of the decking system and additionally may present potential danger to those walking on it. It would be desirable, therefore, to provide an improved flat panel decking system in which shifting of the adjacent panels is avoided yet which does not detract from the portability of the system.

SUMMARY OF THE INVENTION

The invention includes the use of a special connector-spacer by which adjacent edges of adjacent decking panels may be connected together firmly and in a predictable spacing, but in a manner that enables the panels to be detached readily. The connector is W-shaped in cross-section to define a pair of parallel channels that receive the adjacent frames of adjacent deck panels. Preferably two such connectors are placed along the adjacent edges of a pair of adjacent panels. Each of the two channels of each connector-spacer has inner and outer side walls and a connective bottom wall. The upper end of each channel is open to receive the frame of a deck panel. The inner side walls of the connector-spacer are secured rigidly to each other and are spaced a predetermined amount to control the intended spacing between adjacent edges of the top boards of adjacent decking panels. The outer walls of each channel are inclined upwardly and inwardly at a slight angle to define a slightly constricted entry into the channel. The constricted entry is slightly narrower than the thickness of the frame that is to be inserted into the channel. The bottom of the channel width is adequate to receive the frame. The outer walls of each channel are sufficiently flexible so that as the frame is urged into the channel, the outer wall will flex sufficiently to permit entry of the frame. When the frame has been pressed into the channel, the outer wall effects a firm frictional grip on the frame. An adjacent frame is placed in the other channel with the central member serving to space the panels by a predetermined amount. Although the connector-spacers are sufficient to maintain a secure grip to stabilize the deck panels, the deck panels are easily detached to enable movement, rearrangement or seasonal storage of the deck panels.

It is among the general objects of the invention to provide an improved deck panel system in which the deck panels are securely yet detachably connected to each other.

Another object of the invention is to provide an improved deck system in which the edge of a panel is uniformly spaced from the edge of an adjacent panel.

An additional object of the invention is to provide an improved deck system which is easily disassembled and lends itself to portable use.

A further object of the invention is to provide an improved deck panel system and connector-spacer for use therewith by which the frames of adjacent deck panels are attached to the connector by frictional engagement.

Another object of the invention is to provide a deck system of the type described which may be assembled without requiring the use of any tools or other conventional fasteners.

DESCRIPTION OF THE DRAWINGS

The foregoing and other objects and advantages of the invention will be appreciated more fully from the following further description thereof, with reference to the accompanying drawings wherein.

DESCRIPTION OF THE PREFERRED EMBODIMENT

Figure 1:
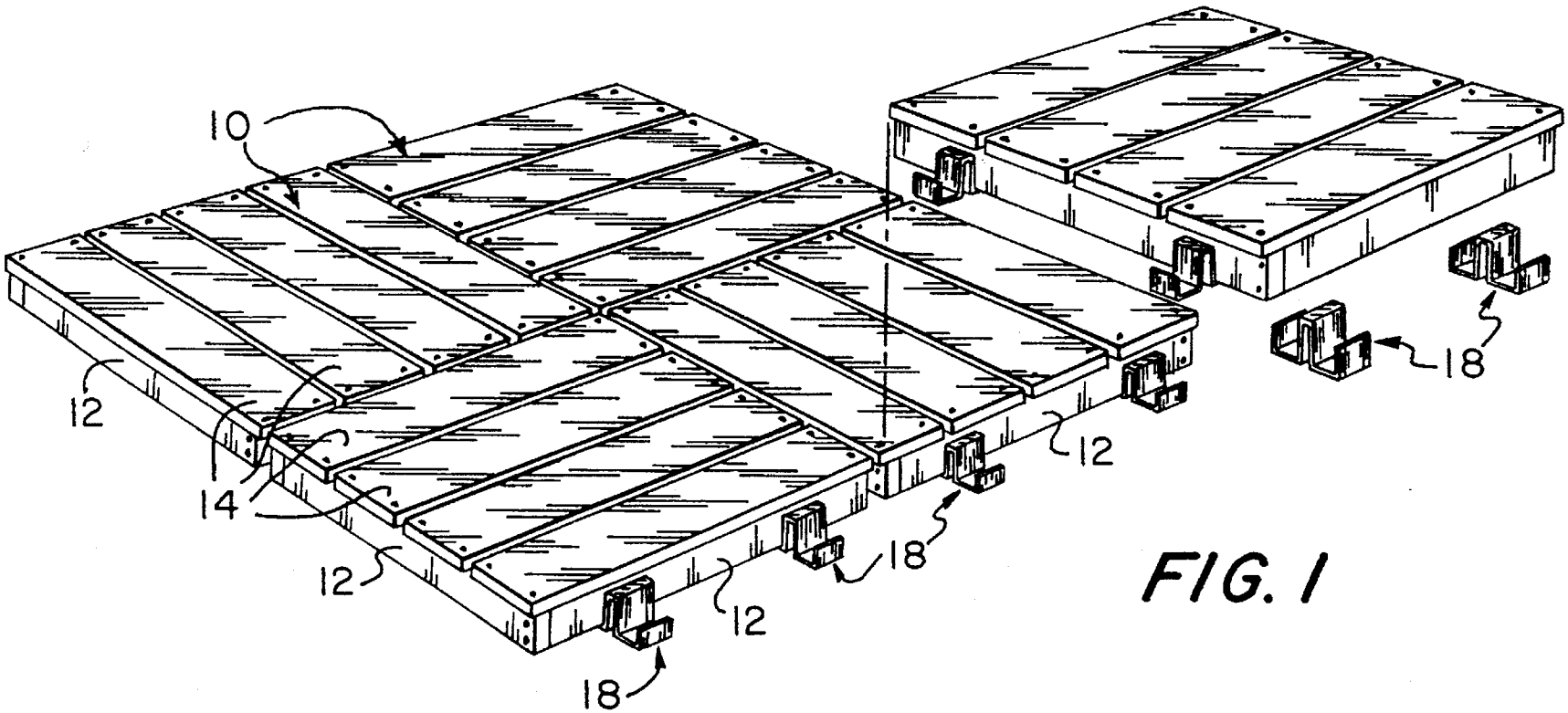
FIG. 1 is an illustration of a number of panels of a decking system attached to each other with the connector-spacer of the present invention.

FIG. 1 illustrates a plurality of deck panels, indicated generally at 10. The panels are illustrated as arranged in a parquet pattern and may form a portion of a deck, walkway or the like. In the illustrative embodiment, each deck panel is rectangular and includes a rectangular frame formed from wood frame members 12. A plurality of surface boards 14 are attached, as by nails, to the frame members 12. The surface boards 14 typically are spaced from each other a predetermined amount, for example, ⅛" to ¼". Preferably, the periphery defined by the surface boards 14 is slightly greater than the periphery defined by the underlying frame so that the surface boards 14 overhang slightly beyond the frame, as indicated at 16 in FIG. 5.

The deck panels 10 are intended to be placed directly on the ground. It is preferred that the panels be placed so that the adjacent edges of the surface boards 14 of adjacent panels are spaced a distance equal to the spacing between surface boards in the deck panel. By maintaining the spacing uniform, the esthetic appearance of the system is preserved. Additionally, when the panels are placed with their boards all extending in the same direction, the decking will appear seamless, that is, the separation between adjacent panels will not be apparent.

Figure 2:
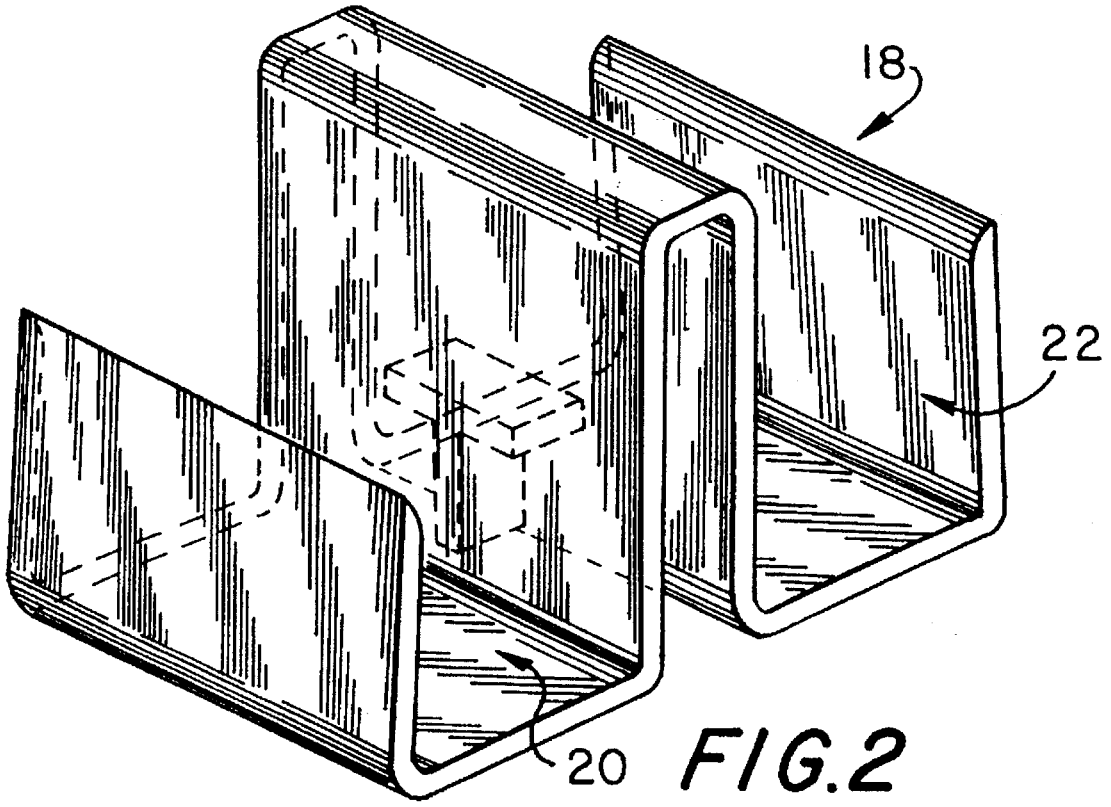
FIG. 2 is an illustration of the connector-spacer of the present invention.
Figure 3:
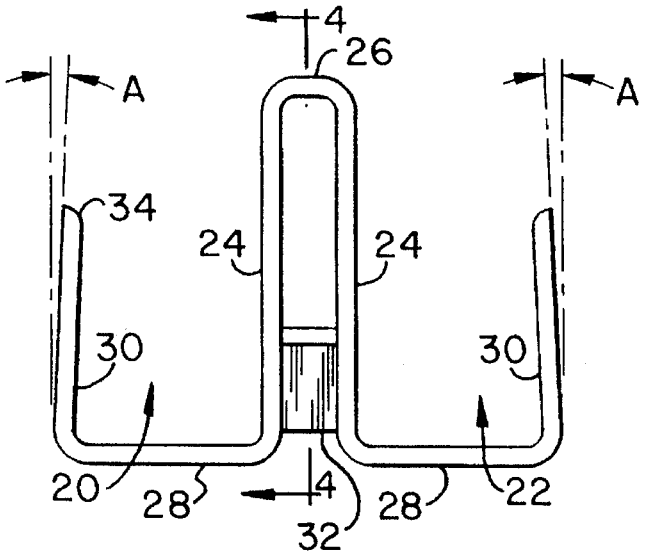
FIG. 3 is an end view of the connector-spacer of the present invention.
Figure 4:
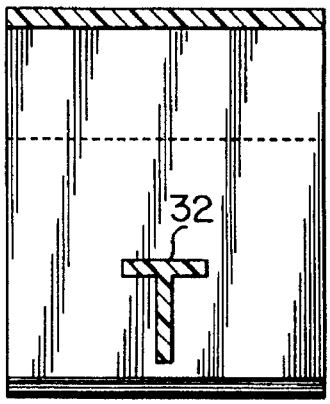
FIG. 4 is an illustration, in section, of the connector-spacer as seen along the line 4—4 of FIG. 3.
Figure 5:
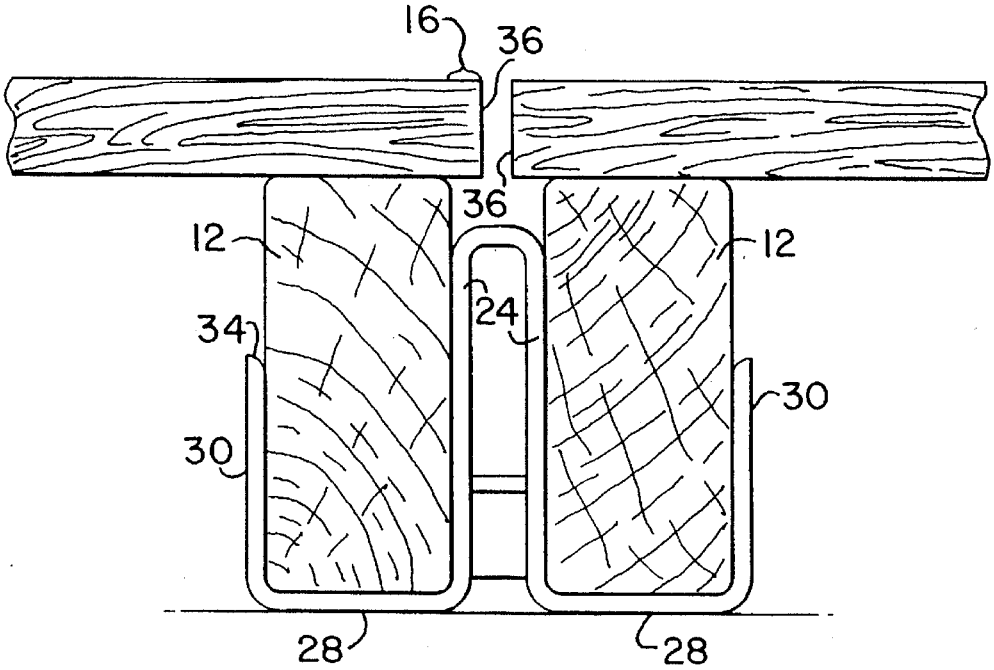
FIG. 5 is an illustration of the connector-spacer engaged with the frames of a pair of adjacent deck panels as seen from an end of the connector-fitting and with the frame member in section.

FIGS. 2–4 illustrate the preferred embodiment of the connector used to join the panels together. The connector, indicated generally at 18, preferably is formed from a suitable polymeric material having adequate toughness. Polycarbonate has been found to be suitable. Polycarbonate material displays good memory, is non-corrosive and displays good low temperature operability. In the preferred embodiment of the connector-spacer, the clip is formed to include a pair of channels 20, 22 which are receptive to adjacent frame members 12 of adjacent panels as indicated in FIG. 5. Each of the channels includes an inner wall 24 having upper and lower ends. The upper ends are connected by an integral web 26. The lower ends of the inner walls 24 merge into outwardly extending bottom walls 28 which, in turn, merge into upwardly extending outer walls 30. A stiffener and spacer 32 is secured, as by a suitable adhesive, to the inwardly facing surfaces of the inner walls 24. The stiffening spacer 32 may be T-shaped in cross-section as shown in FIG. 4.

The channels 20, 22 are dimensioned so that their width, along the bottom wall 28 corresponds to the width of the frame members 12. The upper ends of the outer walls 30, however, are inclined inwardly at a slight angle A, of the order of a few degrees. Thus, the spacing between the inner and outer walls 24, 30 is somewhat restricted at the upper entry end. The outer walls 30 and bottom walls 28 are sufficiently flexible so that the walls 30 can flex to expand the width at the upper end of the channel thereby to receive the frame members 12 as indicated in FIG. 5. When the frame members 12 are so received in the channels, the outer walls 30 will be biased inwardly firmly toward and against the frame member 12 to securely grip the frame member 12. The upper ends of the outer walls 30 preferably are formed with smoothly curved inwardly facing surfaces 34 which will engage the frame member and smoothly guide the frame member into the channel while the outer wall 30 flexes outwardly to receive the full width of the frame member 12.

The connector-spacer 18 preferably is formed with its inner walls 24 spaced so that the adjacent edges of the surface boards 14 of adjacent deck panels 10 will have the same spacing that exists between adjacent surface boards 14 within a given deck panel. Thus, as illustrated in FIG. 5, it will be appreciated that the device is formed so that the inner walls 24 will maintain the spacing of the adjacent edges 36 of adjacent panels. Such uniform spacing is illustrated in FIG. 1 from which it can be seen that the spacing between the surface boards of adjacent panels 10 corresponds to that between the adjacent surface boards 14 in a single panel and presents a satisfactory overall appearance. The web 26 and inner spacer 32 are dimensioned accordingly.

By way of dimensional example, for a system including deck panels in which the frames are formed from conventional two by fours (having actual cross-sectional dimensions 1.5"×3.5"). The width of each channel at its bottom preferably is 1.5". The height of the device measured from the underside of the bottom wall 28 to the top of the web 26 preferably is 3". The height of the outer walls 30 is 2". The width of the central portion is measured between outwardly facing surfaces of the inner walls 24 preferably is 0.75". The walls and webs preferably are of the order of 0.150" thickness throughout the device.

Also among the features of the invention is that the connector-spacer is not readily visible because it is substantially concealed by the deck panels. This is apparent from FIG. 5 from which it may be seen that the approximate ¼" space between edges 36 of adjacent panels does not provide sufficient space to see easily the web 26 of the connectors. The connectors may be injected molded or extruded and cut from lengths of the extrusions. Preferably the W-shaped portion is formed first and the T-shaped brace is inserted and adhesively attached in a separate step.

From the foregoing it will be appreciated that the invention provides for a decking system in which panels can be attached, edge-to-edge, easily and securely thereby assuring that they will not shift out of position. The connectors are effective to secure the panels together and to maintain them at a desired spacing. A decking system using the connector spacers can be assembled easily without requiring special tools or connectors and also is easily disassembled, thus enhancing its portability.

It should be understood, however, that the foregoing description of the invention is intended merely to be illustrative thereof and that other embodiments, modifications and equivalents may be apparent to those skilled in the art without departing from its spirit.

Having thus described the invention what I desire to claim and secure by Letters Patent is:

1. A self-supporting portable decking system placeable directly on the ground and being formed of a plurality of individually detachable decking panels and connectors therefor comprising:

each of the decking panels having a horizontal decking surface and frame members exposed at and projecting downwardly from the underside of the panel, the frame members extending along and adjacent to the edges of the panel, and at least one surface member attached to and spanning the frame members thereby to define the decking surface;

a plurality of connectors for connecting adjacent edges of adjacent panels, each of the connectors comprising a pair of upwardly open, parallel channels, each channel having an inner wall, an outer wall, and a bottom wall connecting the inner and outer walls;

the inner walls of the channels being connected in spaced relation to each other;

the inner and outer walls of each channel being substantially parallel with each other;

the space between the inner wall and the upper end of the outer wall of each channel being less than the space between the inner and outer walls at the lower ends thereof and being configured to enable a frame member having a width corresponding to the width of the channel at the bottom of the channel to be urged downwardly into the channel;

the walls of the channels being sufficiently flexible and being spaced as to yield outwardly when a frame member having width corresponding to the width of the channel at the bottom of the channel is inserted downwardly into the channel, the walls being resilient to grip the frame member;

the connector being a separate member from the panels and enabling connection of frame members of adjacent panels at any location along the frame members, the connector further enabling detachment of the frame member by relative upward withdrawal of the frame member from the channel;

whereby a plurality of said panels can be connected in a self-supporting, free-standing, edge-to-edge array on a substantially horizontal supporting surface;

the frame members of adjacent deck panels being received in a pair of channels of at least one of said connectors to define said array.

2. A decking system as defined in claim 1 wherein adjacent frame members of adjacent panels are connected by at least two of said connectors.

3. A decking system as defined in claim 1 wherein each of the frame members is gripped frictionally between the inner and outer walls of its receptive channel.

4. A decking system as defined in claim 1 wherein the peripheral edge of the upper decking surface of each panel overhangs beyond the dimension of the underlying frame members;

the spacing between the inner walls of the channels in each connector being such as to engage the frame members so that adjacent edges of adjacent deck surfaces of adjacent deck panels have a predetermined spacing.

5. A decking system as defined in claim 3 wherein the upper decking surface comprises a plurality of boards having adjacent edges spaced from each other by a predetermined amount;

the spacing of the inner walls of the channels in each connector being such as to space the adjacent edges of adjacent decking surfaces on adjacent panels by said amount.

6. A portable decking system of a plurality of decking panels and connectors therefor comprising:

each of the decking panels having rigid structural frame members exposed at the underside of the panel and extending along the edges of the panel and at least one surface member attached to and spanning the frame members thereby to define a decking surface;

a plurality of independent connectors separate from the panels for connecting the panels in an edge-to-edge array, the connectors having an upwardly opening channel configuration, each connector being adapted to receive and detachably engage two frame members of a pair of adjacent decking panels, the connectors being adapted to receive the frame members in any location along the frame members by direct downward insertion and enabling withdrawal of the frame members by direct upward removal.

7. A portable decking system as defined in claim 1 wherein the frame members are disposed slightly inwardly from the edges of the panel thereby to define an overhanging margin about the periphery of the panel.

8. A decking system as defined in claim 1 further comprising the inner walls of the channels being secured to each other at the upper and lower portions thereof.

9. A decking system as defined in any one of claims 1 or 8 in which the outer walls of the connector are inclined inwardly at a slight angle to the plane of the inner wall, the outer wall being constructed to flex outwardly to a width sufficient to receive and frictionally grip the frame member.

10. A system as defined in claim 9 further comprising the upper edge of the inner surface of each outer wall being beveled thereby to facilitate insertion of a frame member inserted into the channel.

11. A system as defined in claim 9 wherein the angle is of the order of a few degrees.

12. A system as defined in claim 11 wherein said angle is 2.5°.

13. A system as defined in either one of claims 1 or 8 wherein the faces of the inner and outer walls that define the channel are configured to maximize the frictional grip of the walls on a frame member.

14. A system as defined in claim 9 wherein the faces of the inner and outer walls that define the channel are configured to maximize the frictional grip of the walls on a frame member.

15. A system as defined in either one of claims 1 or 8 formed from a single unitary piece of polycarbonate polymer.

16. A connector as defined in claim 13 further comprising:

the inwardly facing surfaces of each of the inner and outer walls of the channel each being adapted to engage frictionally the frame fully along the facing surfaces of the wall.

17. A connector as defined in claim 14 wherein the inwardly facing surfaces of each of the inner and outer walls of the channel each being adapted to engage frictionally the frame fully along the facing surfaces of the wall.

18. A connector as defined in claim 1 wherein the length of the connector is substantially less than the length of the frame member adapted to be received in the connector.

19. A connector as defined in claim 1 wherein the inner walls, outer walls and bottom walls are defined by a unitary, one-piece construction.

20. A connector as defined in claim 1 wherein the bottom walls lie in substantially the same plane and define a flat surface within and outside of the channel.

21. A portable decking system of a plurality of decking panels and connectors therefor comprising:

each of the decking panels having rigid structural frame members exposed at the underside of the panel and extending along the edges of the panel and at least one surface member attached to and spanning the frame members thereby to define a decking surface;

a plurality of independent connectors separate from the panels for connecting the panels in edge-to-edge array, the connectors being constructed to engage the frame members in a manner that permits the frame members to be connected or detached from the connectors by relative heightwise movement of the panel with respect to the connectors whereby the decking panels can be placed and removed independently of each other.

* * * * *